US007394443B2

(12) United States Patent
Baek et al.

(10) Patent No.: US 7,394,443 B2
(45) Date of Patent: Jul. 1, 2008

(54) APPARATUS AND METHOD FOR DRIVING LIQUID CRYSTAL DISPLAY

(75) Inventors: Jong Sang Baek, Kumi-shi (KR); Sun Young Kwon, Kumi-shi (KR)

(73) Assignee: LG Display Co., Ltd., Seoul (KR)

( * ) Notice: Subject to any disclaimer, the term of this patent is extended or adjusted under 35 U.S.C. 154(b) by 640 days.

(21) Appl. No.: 10/875,568

(22) Filed: Jun. 25, 2004

(65) Prior Publication Data

US 2005/0105319 A1 May 19, 2005

(30) Foreign Application Priority Data

Nov. 19, 2003 (KR) ..... 10-2003-0082258

(51) Int. Cl.
*G09G 3/36* (2006.01)

(52) U.S. Cl. ..... 345/87; 345/99

(58) Field of Classification Search ..... 345/87–100
See application file for complete search history.

(56) References Cited

U.S. PATENT DOCUMENTS 5,115,228 A * 5/1992 Harris et al. ..... 345/5
2002/0186193 A1* 12/2002 Lee et al. ..... 345/96

* cited by examiner

*Primary Examiner*—Amr A. Awad
*Assistant Examiner*—Daniel Tsegaye
(74) *Attorney, Agent, or Firm*—McKenna Long & Aldridge LLP

(57) ABSTRACT

A apparatus and method for driving a liquid crystal display that minimizes the generation of electromagnetic interference (EMI) in a cost effective manner includes a gate control signal generator that generates a gate control signal using a externally inputted synchronizing signal, a data control signal generator that generates a data control signal using the synchronizing signal, a data aligner that re-aligns externally inputted video data, a plurality of buffers at output terminals of the gate control signal generator, the data control signal generator and the data aligner, and a control unit that applies control signals to the buffers to control current values of signals outputted by the buffers.

13 Claims, 7 Drawing Sheets

APPARATUS AND METHOD FOR DRIVING LIQUID CRYSTAL DISPLAY

This application claims the benefit of Korean Patent Application No. P2003-82258, filed on Nov. 19, 2003, which is hereby incorporated by reference for all purposes as if fully set forth herein.

BACKGROUND OF THE INVENTION

1. Field of the Invention

The present invention relates to liquid crystal displays (LCDs). More particularly, the present invention relates to an apparatus and method for driving LCDs that minimizes the generation of electromagnetic interference (EMI) in a cost efficient manner.

2. Discussion of the Related Art

Generally, LCDs display pictures by controlling light transmittance characteristics of liquid crystal cells in accordance with received video signals. Active matrix type LCDs include switching devices (usually a thin film transistor (TFT)) coupled to liquid crystal cells. Such active matrix type LCDs are often used as monitors for computers, office equipment, cellular phones, and the like.

FIG. 1 illustrates a related art LCD driving apparatus.

Referring to FIG. 1, the related art LCD driving apparatus includes an LCD panel 2 having m×n liquid crystal cells Clc arranged in a matrix pattern, m data lines D1 to Dm, n gate lines G1 to Gn crossing the m data lines D1 to Dm, TFTs provided at the crossings of the data and gate lines, a data driver 4 for applying data signals to the data lines D1 to Dm, a gate driver 6 for applying scanning signals to the gate lines G1 to Gn, a gamma voltage supplier 8 for supplying the data driver 4 with gamma voltages, a timing controller 10 for controlling the data driver 4 and the gate driver 6 using synchronizing signals outputted from a system 20, a direct current to direct current (DC/DC) converter 14 for generating voltages supplied to the LCD panel 2 using a voltage outputted from a power supply 12, an inverter 16 for driving a back light 18, and a filter array 22 for minimizing the generation of electromagnetic interference (EMI).

The system 20 outputs vertical signals Vsync, horizontal signals Hsync, clock signals DCLK, a data enable signal DE, and R, G and B data to the timing controller 10.

The LCD panel 2 includes a plurality of liquid crystal cells Clc arranged in a matrix pattern at the crossings of the plurality of data lines D1 to Dm and the plurality of gate lines G1 to Gn. TFTs are provided at each liquid crystal cell Clc to apply data signals, transmitted by the data lines D1 to Dm, to corresponding liquid crystal cells Clc in response to scanning signals transmitted by gate lines G1 to Gn. Further, a storage capacitor Cst is provided either between a pixel electrode of each liquid crystal cell Clc and a pre-stage gate line or between the pixel electrode of each liquid crystal cell Clc and a common electrode line. The storage capacitor Cst functions to maintain a voltage charged within the liquid crystal cell Clc.

The gamma voltage supplier 8 applies a plurality of gamma voltages to the data driver 4.

The data driver 4 converts digital R, G and B video data into analog gamma voltages (i.e., data signals) having predetermined gray level values and applies the data signals to the data lines D1 to Dm in response to data control signals DCS outputted from the timing controller 10.

The gate driver 6 sequentially applies scanning pulses to the gate lines G1 to Gn in response to a gate control signal GCS outputted from the timing controller 10. Accordingly, the gate driver 6 selects horizontal lines of liquid crystal cells Clc within the LCD panel 2 that are supplied with data signals.

The DC/DC converter 14 generates a supply voltage for the LCD panel 2 by either boosting or dropping a voltage of 3.3V outputted from the power supply 12. The DC/DC converter 14 also generates a gamma reference voltage, a gate high voltage VGH, a gate low voltage VGL, a common voltage Vcom, etc.

The inverter 16 drives the backlight 18 by applying a driving voltage (or driving current) thereto. Upon receipt of the driving voltage (or driving current), the backlight 18 emits light to the LCD panel 2.

Using the vertical/horizontal synchronizing signals Vsync and Hsync and the clock signal DCLK outputted from the system 20, the timing controller 10 generates the gate and data control signals GCS and DCS, respectively, for controlling the gate and data drivers 6 and 4, respectively.

To this end, and with reference to FIG. 2, the related art timing controller 10 includes a gate control signal generator 30 for generating the gate control signals GCS which, in turn, control the gate driver 6, a data control signal generator 32 for generating the data control signals DCS which, in turn, control the data driver 4, a data aligner 34 for re-aligning the R, G and B data outputted by the system 20 and for applying the re-aligned R, G, and B data to the data driver 4, and a control unit 33 for controlling the gate signal generator 30, the data control signal generator 32, and the data aligner 34. Specifically, the control unit 33 controls the gate control signal generator 30 to generate gate control signals GCS (i.e., gate start pulse GSP, gate shift clock GCS, and gate output enable signal GOE), controls the data control signal generator 32 to generate data control signals DCS (i.e., source start pulse SSP, source shift clock SSC, source output enable signal SOE, and polarity signal POL); and controls the data aligner 34 to re-align externally inputted R, G and B data.

First, second, and third buffers 36, 37, and 38, respectively, are provided at respective outputs of the gate control signal generator 30, the data control signal generator 32, and the data aligner 34.

The first buffer 36 ensures that the current value of gate control signals GCS outputted from the gate control signal generator 30 are maintained at a predetermined value. Similarly, the second buffer 37 ensures that the current value of the data control signals DCS outputted from the data control signal generator 32 are maintained at a predetermined value. The predetermined current values of the gate and data control signals GCS and DCS are values sufficient to ensure that the gate and data control signals GCS and DCS are suitably applied to each integrated circuit within the gate and data drivers 6 and 4, respectively. The third buffer 38 ensures that the current value of the R, G and B data outputted from the data aligner 34 are maintained at a predetermined value, facilitating stable outputting of data.

The filter array 22 is provided between the timing controller 10 and the data and gate drivers 4 and 6, respectively, and controls waveforms of the gate control signal GCS, the data control signal DCS, and the R, G and B data outputted from the timing controller 10 to minimize the generation of electromagnetic interference (EMI). To this end, the related art filter array 22 includes a first filter 22*a* connected to the first buffer 36 to filter waveforms of the gate control signals GCS, a second filter 22*b* connected to the second buffer 37 to filter waveforms of the data control signals DCS, and a third filter 22*c* connected to the third buffer 38 to filter waveforms of the R, G, and B data.

With specific reference to FIG. 3, the various signals outputted to the first, second, and third filters 22*a*, 22*b*, and 22*c* are characterized as having rectangular waveforms. After being filtered by the first to third filters 22*a-c*, however, the various signals are characterized as having sloped waveforms, experimentally determined to beneficially minimize the generation of electro-magnetic interference (EMI).

Use of the aforementioned related art LCD including the filter array 22 however, is disadvantageous because it can be very expensive to manufacture. Further, if the filter array 22 is mounted onto a printed circuit board (PCB), then design flexibility of the PCB may become unduly limited.

SUMMARY OF THE INVENTION

Accordingly, the present invention is directed to an apparatus and method for driving a liquid crystal display that substantially obviates one or more of the problems due to limitations and disadvantages of the related art.

An advantage of the present invention provides an apparatus and method for driving LCDs that minimize the generation of electromagnetic interference (EMI) in a cost efficient manner.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a driving apparatus for an LCD according may, for example, include a gate control signal generator that generates gate control signals using an externally inputted synchronizing signal; a data control signal generator that generates data control signals using the synchronizing signal; a data aligner that re-aligns externally inputted data; a plurality of buffers provided at output terminals of the gate control signal generator, the data control signal generator, and the data aligner; and a control unit that applies control signals to the plurality of buffers to control characteristics of signals outputted by the plurality of buffers.

In one aspect of the present invention, the plurality of buffers may, for example, include a first buffer that receives the gate control signals outputted from the gate control signal generator at a first current value and outputs the received gate control signal at a second current value in accordance with a control signal outputted by the control unit; a second buffer that receives the data control signals outputted from the data control signal generator at a first current value and outputs the received data control signal at a second current value in accordance with a control signal outputted by the control unit; and a third buffer that receives the re-aligned data outputted from the data aligner at a first current value and outputs the received data at a second current value in accordance with a control signal outputted by the control unit.

In another aspect of the present invention, the plurality of buffers may, for example, include a first buffer that receives the gate control signals outputted from the gate control signal generator as having a rectangular waveform and outputs the received gate control signal as having a sloped waveform in accordance with a control signal outputted by the control unit; a second buffer that receives the data control signals outputted from the data control signal generator as having a rectangular waveform and outputs the received data control signal as having a sloped waveform in accordance with a control signal outputted by the control unit; and a third buffer that receives the re-aligned data outputted from the data aligner as having a rectangular waveform and outputs the received data as having a sloped waveform in accordance with a control signal outputted by the control unit.

In still another aspect of the present invention, the gate control signal generator, said data control signal generator, said data aligner, and said buffers may be within an interior of the timing controller.

In yet another aspect of the present invention, the control unit may be provided within the interior of the timing controller to generate the gate and data control signals and to control the gate control signal generator, the data control signal generator, and the data aligner such that said data is re-aligned.

In still a further aspect of the present invention, the control unit may be provided exterior to the timing controller.

According to principles of the present invention, a method of driving a liquid crystal display may, for example, include steps of generating a gate control signal via an externally inputted synchronizing signal, wherein the gate control signal controls a gate driver; generating a data control signal via said synchronizing signal, wherein the data control signal controls a data driver; re-aligning externally applied video data to be applied to the data driver; generating a first control signal to control a characteristic of said generated gate control signal; generating a second control signal to control a characteristic of said generated data control signal; and generating a third control signal to control a characteristic of said re-aligned data.

In one aspect of the present invention, the step of generating the first to third control signals may, for example, include generating the first control signal to reduce a current value of said generated gate control signal, wherein said gate control signal having the reduced current value controls the gate driver; generating the second control signal to reduce a current value of said generated data control signal, wherein said data control signal having the reduced current value controls the data driver; and generating the third control signal to reduce a current value of said re-aligned data, wherein said re-aligned data having the reduced current value is applied to the data driver.

In another aspect of the present invention, the step of generating the first to third control signals may, for example, include generating the first control signal to change the shape of a waveform of said generated gate control signal, wherein said gate control signal having the waveform with the changed shape controls the gate driver; generating the second control signal to change the shape of a waveform of said generated data control signal, wherein said data control signal having the waveform with the changed shape controls the data driver; and generating the third control signal to change the shape of a waveform of said re-aligned data, wherein said re-aligned data having the waveform with the changed shape is applied to the data driver.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 4:
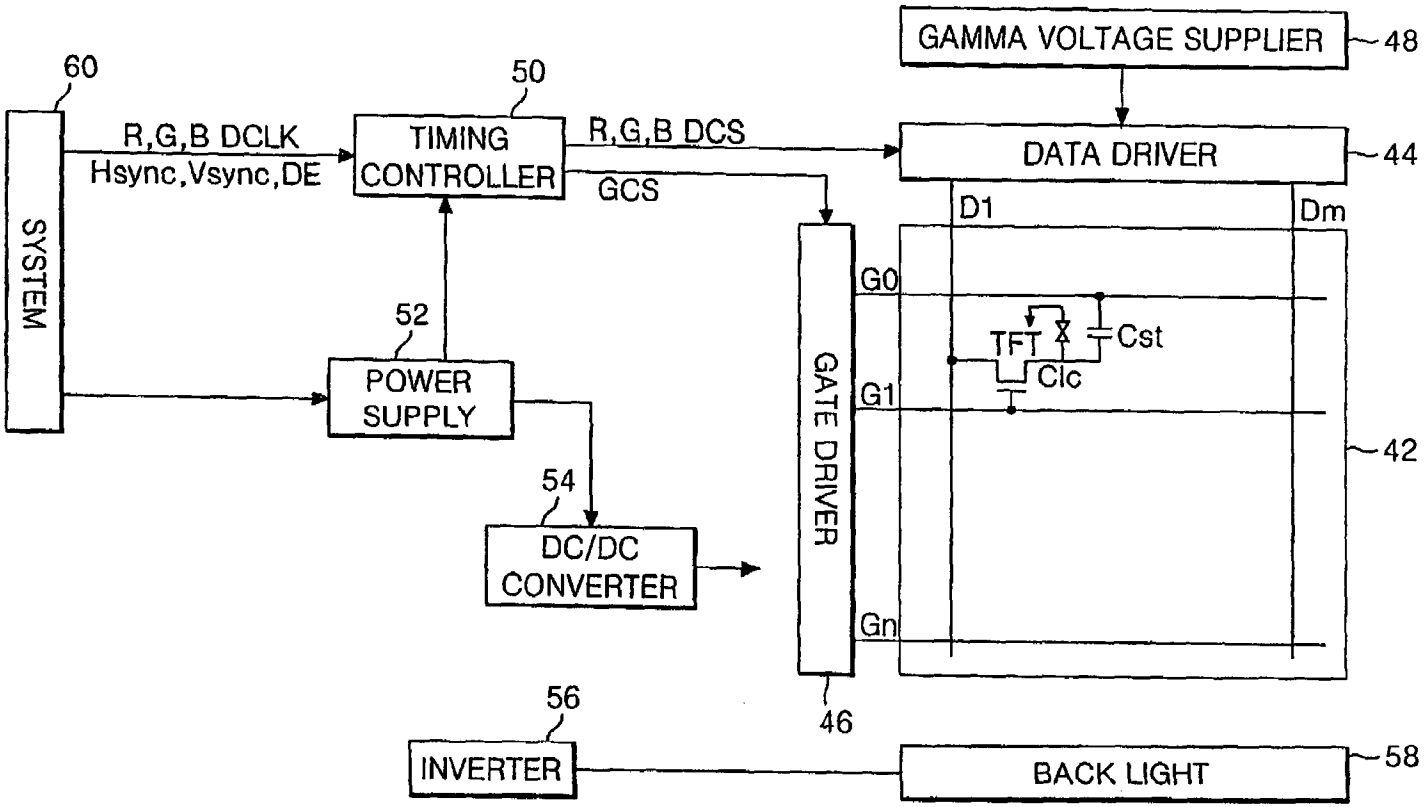
FIG. 4 illustrates an LCD driving apparatus according to one aspect of the present invention.

FIG. 4 illustrates an LCD driving apparatus according to one aspect of the present invention.

Referring to FIG. 4, the LCD driving apparatus according to principles of the present invention may, for example, include an LCD panel 42 having m×n liquid crystal cells Clc arranged in a matrix pattern, m data lines D1 to Dm, n gate lines G1 to Gn crossing the m data lines D1 to Dm, TFTs provided at the crossings of the data and gate lines, a data driver 44 for applying data signals to the data lines D1 to Dm, a gate driver 46 for applying scanning signals to the gate lines G1 to Gn, a gamma voltage supplier 48 for supplying the data driver 44 with gamma voltages, a timing controller 50 for controlling the data driver 44 and the gate driver 46 using a synchronizing signal outputted from a system 60, a DC/DC converter 54 for generating voltages supplied to the liquid crystal display panel 42 using a voltage outputted from a power supply 52, and an inverter 56 for driving a back light unit 58.

The system 40 may, for example, output vertical signals Vsync, horizontal signals Hsync, clock signals DCLK, a data enable signal DE, and R, G and B data to the timing controller 50.

The LCD panel 42 may, for example, include a plurality of liquid crystal cells Clc arranged in a matrix pattern at the crossings of the data lines D1 to Dm and the gate lines G1 to Gn. TFTs are provided at the liquid crystal cells Clc to apply a data signals, transmitted by the data lines D1 to Dm, to corresponding liquid crystal cells Clc in response to scanning signals transmitted by the gate lines G1 to Gn. Further, a storage capacitor Cst is provided either between a pixel electrode of each liquid crystal cell Clc and a pre-stage gate line or between the pixel electrode of each liquid crystal cell Clc and a common electrode line. The storage capacitor Cst functions to maintain a voltage charged within the liquid crystal cell Clc.

The gamma voltage supplier 48 may, for example, apply a plurality of gamma voltages to the data driver 44.

The data driver 44 may, for example, convert digital R, G and B video data into analog gamma voltages (i.e., data signals) having predetermined gray level values and apply the data signals to the data lines D1 to Dm in response to data control signals DCS outputted from the timing controller 50.

The gate driver 46 may, for example, sequentially apply scanning pulses to the gate lines G1 to Gn in response to a gate control signal GCS from the timing controller 50. Accordingly, the gate driver 46 may select horizontal lines of liquid crystal cells Clc within the LCD panel 42 which are supplied with data signals.

The DC/DC converter 54 may, for example, generate a supply voltage for the LCD panel 42 by boosting or dropping a voltage of 3.3V outputted from the power supply 52. In one aspect of the present invention, the DC/DC converter 54 may generate a gamma reference voltage, a gate high voltage VGH, a gate low voltage VGL, a common voltage Vcom, and the like.

The inverter 56 may, for example, drive the backlight 58 by applying a driving voltage (or driving current) thereto. Upon receipt of the driving voltage (or driving current), the backlight 58 emits light to the LCD panel 42

Using the vertical/horizontal synchronizing signals Vsync and Hsync and the clock signal DCLK outputted from the system 60, the timing controller 50 may, for example, generate the gate and data control signals GCS and DCS, respectively, to control the gate and data drivers 46 and 44, respectively.

Figure 5:
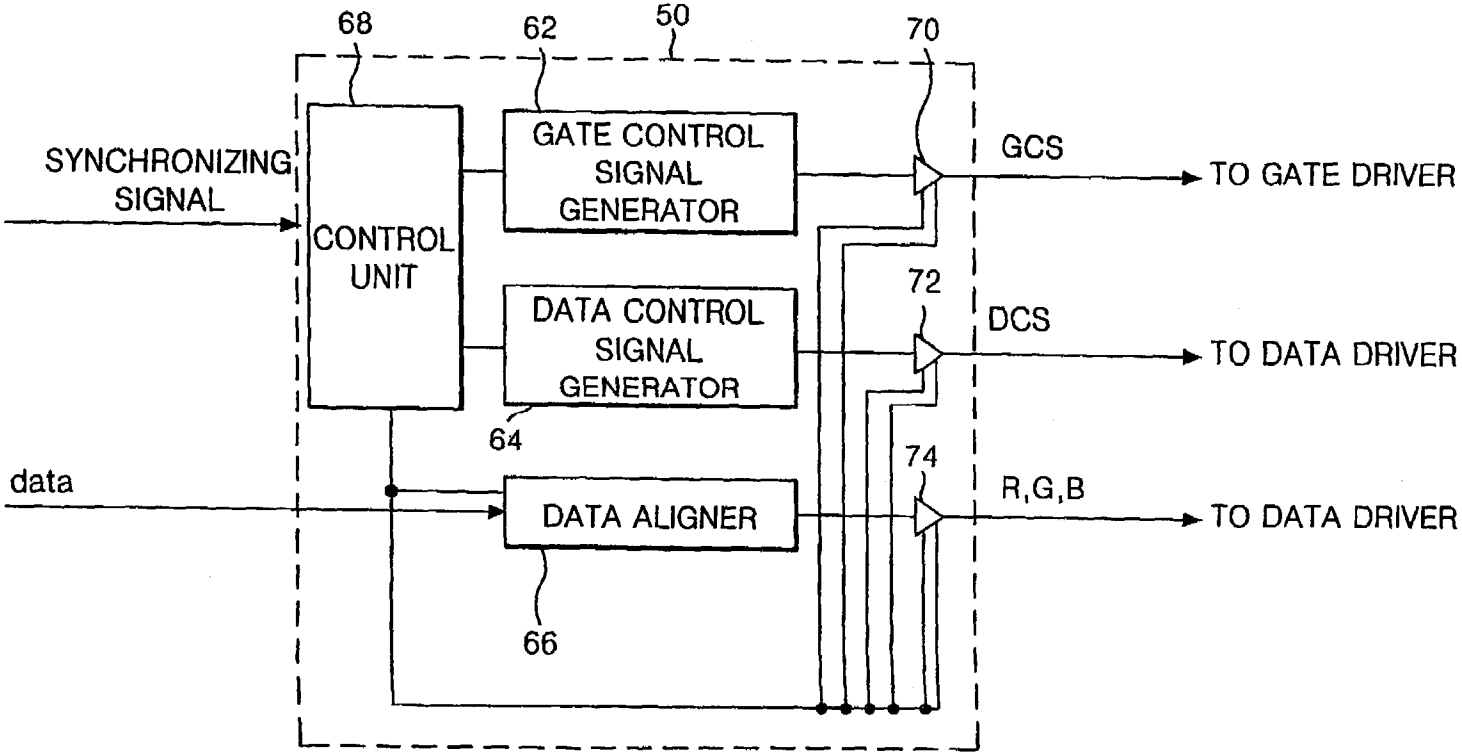
FIG. 5 illustrates the timing controller shown in FIG. 4.

To this end, and with reference to FIG. 5, the timing controller 50 in one aspect of the present invention may, for example, include a gate control signal generator 60 for generating gate control signals GCS which, in turn, control the gate driver 46, a data control signal generator 64 for generating data control signals DCS which, in turn, control the data driver 44, a data aligner 66 for re-aligning the data R, G and B outputted by the system 60 and for applying the re-aligned R, G, and B data to the data driver 44, and a control unit 68 for controlling the gate control signal generator 62, the data control signal generator 64, and the data aligner 66. For example, the control unit 68 may control the gate control signal generator 62 to generate gate control signals GCS (e.g., gate start pulse GSP, gate shift clock GCS, gate output enable signal GOE, etc.), control the data control signal generator 64 to generate data control signals DCS (e.g., source start pulse SSP, source shift clock SSC, source output enable signal SOE, a polarity signal POL, etc.), and control the data aligner 66 to re-align the R, G and B data outputted from the system 60.

First, second, and third buffers 70, 72, and 74, respectively, may be provided at respective outputs of the gate control signal generator 62, the data control signal generator 64, and the data aligner 66.

The first buffer 70 may be connected to the output of the gate control signal generator 62 and ensure that current values of gate control signals GCS outputted from the gate control signal generator 62 are maintained at a predetermined value. In one aspect of the present invention, current values of the gate control signals GCS outputted by the first buffer 70 may be controlled by the control unit 68. For example, the first buffer 70 may maintain the current value of the outputted gate control signals GCS to be about 6 mA, 8 mA, 10 mA, 12 mA, or the like, in response to a control signal outputted from the control unit 68.

Figure 6:
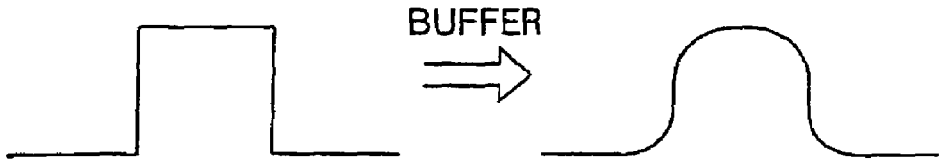
FIG. 6 illustrates an operation of the buffers shown in FIG. 5.

According to principles of the present invention, gate control signals GCS outputted by the gate control signal generator 62 have a rectangular waveform and a first current value. Accordingly, the control signal outputted by the control unit 68 may cause the first buffer 70 to transform the rectangular waveform of the gate control signals GCS outputted by the gate control signal generator 62 into a sloped waveform. In another aspect of the present invention, the control signal outputted by the control unit 68 may cause the first buffer 70 to output gate control signals GCS to the gate driver 46 that have a second current value, wherein the second current value is less than the first current value. For example, if the gate control signals GCS outputted by the gate control signal generator 62 have a rectangular waveform and a first current value of about 10 mA, the control unit 68 outputs a control signal to the first buffer 70 such that gate control signals GCS having a sloped waveform (see FIG. 6), and having a second current value of about 8 mA or 6 mA are outputted to the gate driver 46. Additionally, the second current value outputted by the first buffer 70 may be further controlled depending upon the resolution and size of the LCD panel 42.

Figure 1:
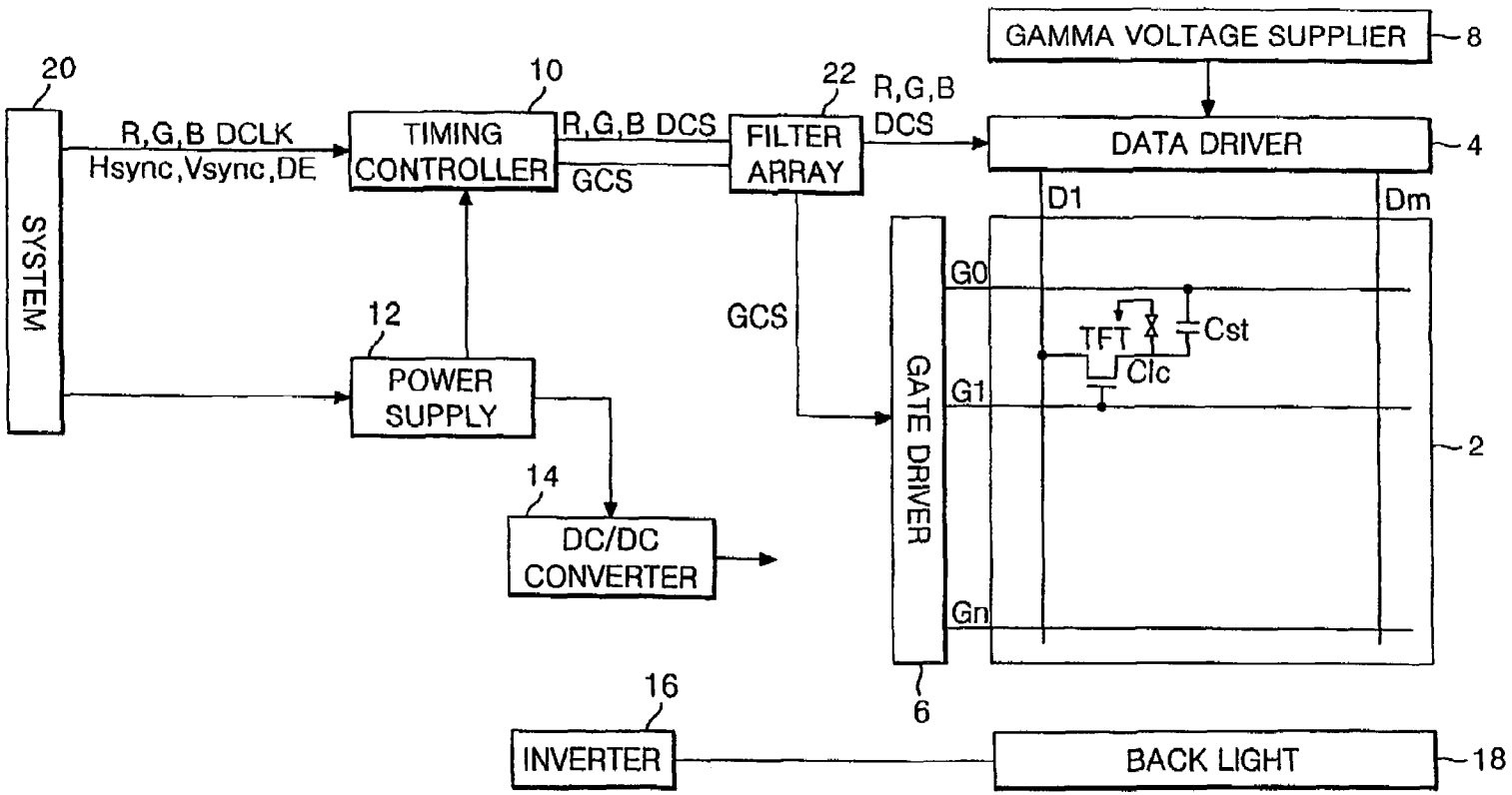
FIG. 1 RELATED ART
FIG. 1 illustrates a related art LCD driving apparatus.
Figure 2:
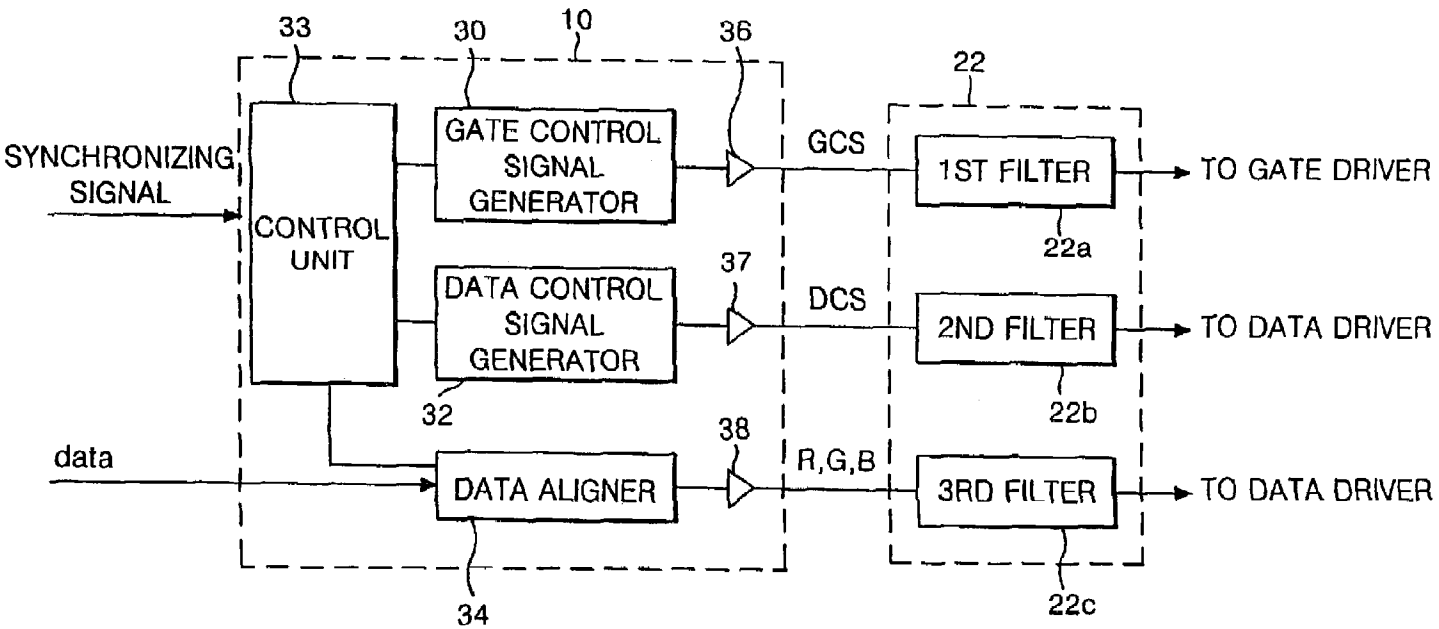
FIG.2 RELATED ART
FIG. 2 illustrates the related art timing controller and filter array shown in FIG. 1.
Figure 3:
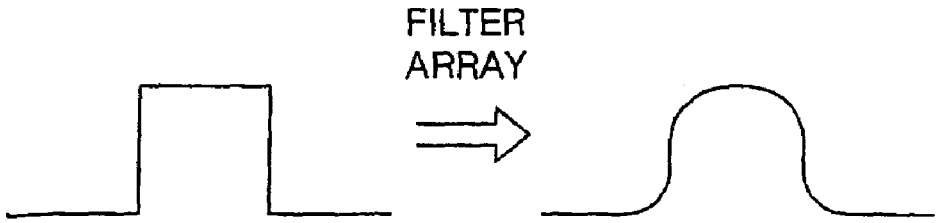
FIG. 3 illustrates an operation of the related art filter array shown in FIG. 1.

In view of the above, the principles of the present invention allow gate control signals GCS to have sloped waveforms without the use of the filter array shown in FIGS. 1 and 3. Accordingly, the principles of the present invention can beneficially minimize the generation of electromagnetic interference (EMI) in a cost effective manner. It should be noted that one of ordinary skill in the art would be able to determine, without undue experimentation, suitable current values that, if outputted by the first buffer 70, would minimize the generation of electromagnetic interference (EMI).

The second buffer 72 may be connected to the output of the data control signal generator 64 and ensure that current values of data control signals DCS outputted from the data control signal generator 64 are maintained at a predetermined value. In one aspect of the present invention, current values of the data control signals DCS outputted by the second buffer 72 may be controlled by the control unit 68. For example, the second buffer 72 may maintain the current value of the outputted data control signals DCS to be about 6 mA, 8 mA, 10 mA, 12 mA, or the like, in response to a control signal outputted from the control unit 68.

According to principles of the present invention, data control signals DCS outputted by the data control signal generator 64 have a rectangular waveform and a first current value. Accordingly, the control signal outputted by the control unit 68 may cause the second buffer 72 to transform the rectangular waveform of the data control signals DCS outputted by the data control signal generator 64 into a sloped waveform. In another aspect of the present invention, the control signal outputted by the control unit 68 may cause the second buffer 72 to output data control signals DCS to the data driver 44 that have a second current value, wherein the second current value is less than the first current value. For example, if the data control signals DCS outputted by the data control signal generator 64 have a rectangular waveform and a first current value of about 8 mA, the control unit 68 outputs a control signal to the second buffer 70 such that data control signals DCS having a sloped waveform (see FIG. 6), and having a second current value of about 6 mA are outputted to the data driver 44. Additionally, the second current value outputted by the second buffer 72 may be further controlled depending upon the resolution and size of the LCD panel 42.

In view of the above, the principles of the present invention allow data control signals DCS to have sloped waveforms without the use of the filter array shown in FIGS. 1 and 3. Accordingly, the principles of the present invention can beneficially minimize the generation of electromagnetic interference (EMI) in a cost effective manner. It should be noted that one of ordinary skill in the art would be able to determine, without undue experimentation, suitable current values that, if outputted by the second buffer 72, would minimize the generation of electromagnetic interference (EMI).

The third buffer 74 may be connected to the data aligner 66 and ensure that current values of the R, G and B data outputted from the data aligner 66 are maintained at a predetermined value. In one aspect of the present invention, current values of R, G, and B data outputted by the third buffer 74 may be controlled by the control unit 68. For example, the third buffer 74 may maintain the current value of the outputted R, G and B data to be about 6 mA, 8 mA, 10 mA, 12 mA, or the like, in response to a control signal outputted from the control unit 68.

According to principles of the present invention, R, G, and B data outputted by the data aligner 66 have a rectangular waveform and a first current value. Accordingly, the control signal outputted by the control unit 68 may cause the third buffer 74 to transform the rectangular waveform of the R, G, and B data outputted by the data aligner 66 into a sloped waveform. In another aspect of the present invention, the control signal outputted by the control unit 68 may cause the third buffer 74 to output R, G, and B data to the data driver 44 that have a second current value, wherein the second current value is less than the first current value. For example, if the R, G, and B data outputted by the data aligner 65 have a rectangular waveform and a first current value of about 12 mA, the control unit 68 outputs a control signal to the third buffer 74 such that R, G, and B data having a sloped waveform (see FIG. 6), and having a second current value of about 10 mA, 8 mA, 6 mA, or the like, are outputted to the data driver 44. Additionally, the second current value outputted by the third buffer 74 may be further controlled depending upon the resolution and size of the LCD panel 42.

In view of the above, the principles of the present invention allow R, G, and B data to have sloped waveforms without the use of the filter array shown in FIGS. 1 and 3. Accordingly, the principles of the present invention can beneficially minimize the generation of electromagnetic interference (EMI) in a cost effective manner. It should be noted that one of ordinary skill in the art would be able to determine, without undue experimentation, suitable current values that, if outputted by the third buffer 74, would minimize the generation of electromagnetic interference (EMI).

Figure 7:
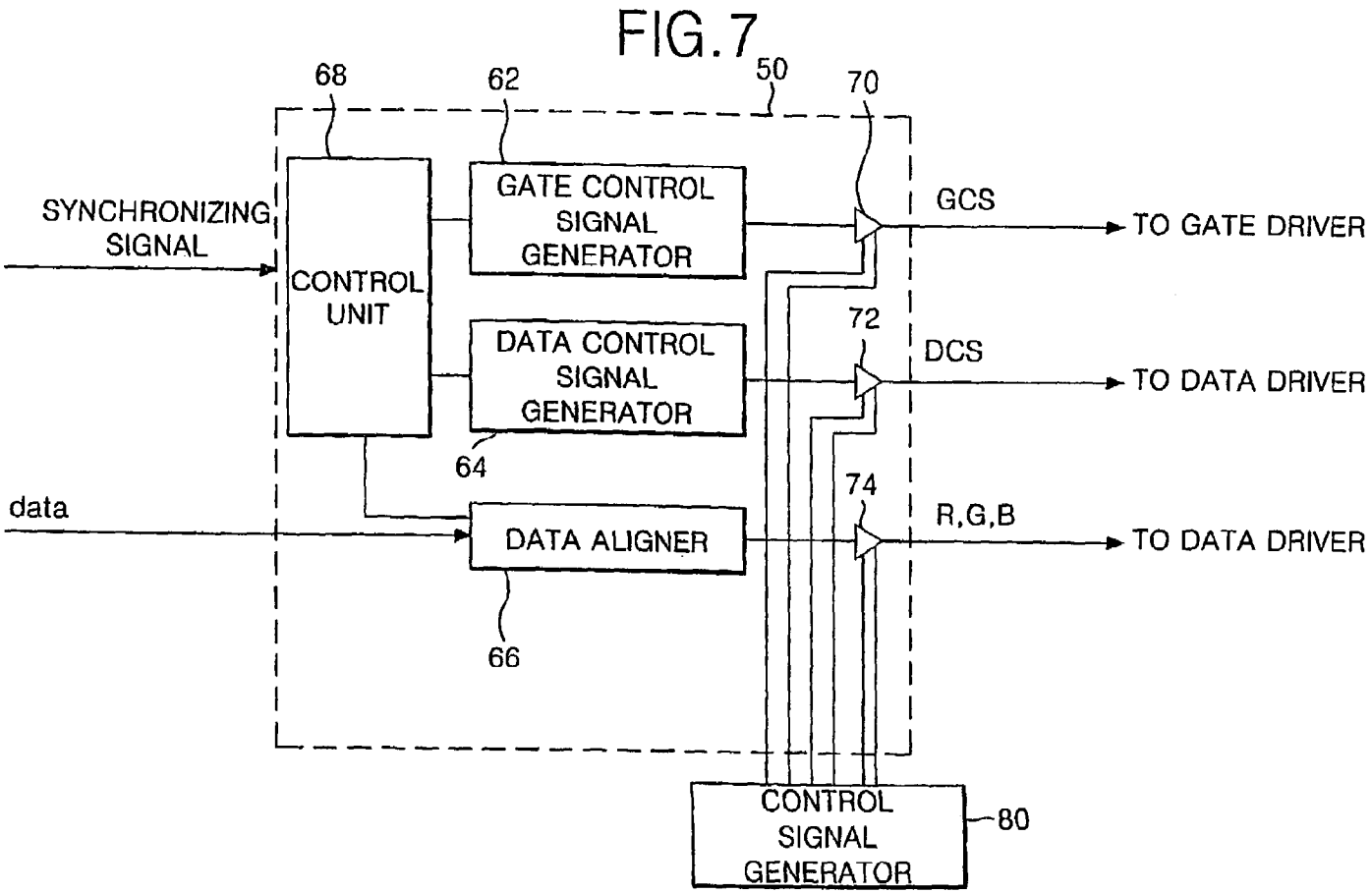
FIG. 7 illustrates an LCD driving apparatus according to another aspect of the present invention.

In an alternative aspect of the present invention, illustrated by way of example in FIG. 7, a control signal generator 80 may be arranged at the exterior of the timing controller 50. The aspect shown in FIG. 7 is identical to the aspect previously described with respect to FIGS. 4-6 with the exception that the control signal generator 80 may be used to control the first to third buffers 70 to 74 instead of the control unit 68. Accordingly, the control signal generator 80 may control current values of signals outputted by the first to third buffers 70 to 74 to effectively minimize the generation of electromagnetic interference (EMI).

As described above, the principles of the present invention allow the current value of signals outputted by a buffer to be controlled, thereby beneficially minimizing the generation of electromagnetic interference (EMI). Accordingly, the buffer is controlled in such a manner that current values of outputted, sloped waveforms are less than current values of equivalent rectangular waveforms inputted thereto, thereby minimizing the generation of electromagnetic interference (EMI) while eliminating the need for expensive filter arrays and removing unnecessary design limitations on PCBs.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A driving apparatus for a liquid crystal display, comprising:

a gate control signal generator that generates gate control signals using an externally inputted synchronizing signal;

a data control signal generator that generates data control signals using the synchronizing signal;

a data aligner that re-aligns externally inputted data;

a plurality of buffers provided at output terminals of the gate control signal generator, the data control signal generator, and the data aligner; and a control unit that applies control signals to the plurality of buffers to control characteristics of signals outputted by the plurality of buffers, wherein said plurality of buffers includes:

a first buffer that receives the gate control signals outputted from the gate control signal generator at a first current value and outputs the received gate control signal at a second current value in accordance with a control signal outputted by the control unit;

a second buffer that receives the data control signals outputted from the data control signal generator at a first current value and outputs the received data control signal at a second current value in accordance with a control signal outputted by the control unit; and a third buffer that receives the re-aligned data outputted from the data aligner at a first current value and outputs the received data at a second current value in accordance with a control signal outputted by the control unit.

2. The driving apparatus as claimed in claim 1, wherein said gate control signal generator, said data control signal generator, said data aligner, and said buffers are within an interior of the timing controller.

3. The driving apparatus as claimed in claim 2, wherein said control unit: is within the interior of the timing controller; controls the gate control signal generator to generate said gate control signal; controls the data control signal generator to generate said data control signal; and controls the data aligner to re-align said data.

4. A driving apparatus for a liquid crystal display comprising:

a gate control signal generator that generates gate control signals using an externally inputted synchronizing signal;

a data control signal generator that generates data control signals using the synchronizing signal;

a data aligner that re-aligns externally inputted data;

a plurality of buffers provided at output terminals of the gate control signal generator, the data control signal generator, and the data aligner; and a control unit that applies control signals to the plurality of buffers to control characteristics of signals outputted by the plurality of buffers, wherein said plurality of buffers includes:

a first buffer that receives the gate control signals outputted from the gate control signal generator as having a rectangular waveform and outputs the received gate control signal as having a sloped waveform in accordance with a control signal outputted by the control unit;

a second buffer that receives the data control signals outputted from the data control signal generator as having a rectangular waveform and outputs the received data control signal as having a sloped waveform in accordance with a control signal outputted by the control unit; and a third buffer that receives the re-aligned data outputted from the data aligner as having a rectangular waveform and outputs the received data as having a sloped waveform in accordance with a control signal outputted by the control unit.

5. A method of driving a liquid crystal display, comprising:

generating a gate control signal via an externally inputted synchronizing signal, wherein the gate control signal controls a gate driver;

generating a data control signal via said synchronizing signal, wherein the data control signal controls a data driver;

re-aligning externally applied video data to be applied to the data driver;

generating a first control signal to control a characteristic of said generated gate control signal;

generating a second control signal to control a characteristic of said generated data control signal; and generating a third control signal to control a characteristic of said re-aligned data;

wherein said step of generating said first to third control signals includes:

generating the first control signal to reduce a current value of said generated gate control signal, wherein said gate control signal having the reduced current value controls the gate driver;

generating the second control signal to reduce a current value of said generated data control signal, wherein said data control signal having the reduced current value controls the data driver; and generating the third control signal to reduce a current value of said re-aligned data, wherein said re-aligned data having the reduced current value is applied to the data driver.

6. A method of diving a liquid crystal display, comprising:

generating a gate control signal via an externally inputted synchronizing signal using a gate control signal generator, wherein the gate control signal controls a gate driver;

providing the generated gate control signal to a first buffer;

generating a data control signal via said synchronizing signal using a data control signal generator, wherein the data control signal controls a data driver;

providing the generated data control signal to a second buffer;

re-aligning externally applied video data to be applied to the data driver using a re-aligner;

providing the re-aligned video data to a third buffer;

generating a first control signal using the control unit to control a characteristic of said generated gate control signal outputted by the first buffer;

generating a second control signal using the control unit to control a characteristic of said generated data control signal outputted by the second buffer; and generating a third control signal using the control unit to control a characteristic of said re-aligned data outputted by the third buffer;

wherein said step of generating said first to third control signals includes:

generating the first control signal to change the shape of a waveform of said generated gate control signal, wherein said gate control signal having the waveform with the changed shape controls the gate driver;

generating the second control signal to change the shape of a waveform of said generated data control signal, wherein said data control signal having the waveform with the changed shape controls the data driver; and generating the third control signal to change the shape of a waveform of said re-aligned data, wherein said re-aligned data having the waveform with the changed shape is applied to the data driver.

7. The method as claimed in claim 6, wherein the shape of the waveform of said generated gate control signal is changed from a rectangular waveform to a sloped waveform.

8. The method as claimed in claim 6, wherein the shape of the waveform of said generated data control signal is changed from a rectangular waveform to a sloped waveform.

9. The method as claimed in claim 6, wherein the shape of the waveform of said re-aligned data is changed from a rectangular waveform to a sloped waveform.

10. A timing controller of a driving apparatus, comprising:

a control unit;

a gate control signal generator connected to the control unit;

a data control signal generator connected to the control unit;

a data aligner connected to the control unit;

a first buffer connected between the gate control signal generator and a first driver of a display;

a second buffer connected between the data control signal generator and a second driver of a display; and a third buffer connected between the data aligner and the data driver; and a control unit that applies control signals to the first to third buffers to control characteristics of signals outputted by the buffers, wherein a first buffer that receives the pate control signals output from the pate control signal generator at a first current value and outputs the received gate control signal at a second current value in accordance with a control signal output by the control unit;

wherein a second buffer that receives the data control signals output from the data control signal generator at a first current value and outputs the received data control signal at a second current value in accordance with a control signal outputs by the control unit; and wherein a third buffer that receives the re-aligned data output from the data aligner at a first current value and outputs the received data at a second current value in accordance with a control signal output by the control unit.

11. The timing controller as claimed in claim 10, wherein the first to third buffers are connected to the control unit.

12. The timing controller as claimed in claim 10, further comprising a control signal generator connected to the first to third buffers.

13. The timing controller as claimed in claim 10, wherein the first driver includes a gate driver; the second driver includes a data driver; and the display includes a liquid crystal display.

* * * * *